US009416567B2

(12) United States Patent
Ji et al.

(10) Patent No.: US 9,416,567 B2
(45) Date of Patent: Aug. 16, 2016

(54) TWO-WAY RELEASABLE MORTISE STRUCTURE

(71) Applicants: Hyoung Jin Ji, Incheon (KR); Sang Han Lee, Seoul (KR)

(72) Inventors: Hyoung Jin Ji, Incheon (KR); Sang Han Lee, Seoul (KR)

(73) Assignees: ELENSYS CO., LTD., Incheon (KR); SAMSUNG SDS CO., LTD., Seoul (KR)

( * ) Notice: Subject to any disclaimer, the term of this patent is extended or adjusted under 35 U.S.C. 154(b) by 396 days.

(21) Appl. No.: 13/865,428

(22) Filed: Apr. 18, 2013

(65) Prior Publication Data

US 2013/0277988 A1 Oct. 24, 2013

(51) Int. Cl.

| | |
|---|---|
| ***E05B 59/00*** | (2006.01) |
| ***E05C 1/08*** | (2006.01) |
| ***E05B 47/00*** | (2006.01) |
| ***E05B 47/02*** | (2006.01) |
| ***E05B 53/00*** | (2006.01) |
| ***E05C 1/12*** | (2006.01) |
| *E05C 9/12* | (2006.01) |
| *E05B 1/00* | (2006.01) |

(52) U.S. Cl.

CPC ..... *E05C 1/08* (2013.01); *E05B 47/0012* (2013.01); *E05B 47/026* (2013.01); *E05B 53/00* (2013.01); *E05B 59/00* (2013.01); *E05C 1/12* (2013.01); *E05B 2001/0076* (2013.01); *Y10T 292/0836* (2015.04)

(58) Field of Classification Search

CPC ..... E05C 1/00; E05C 1/08; E05C 1/12; E05C 1/16; E05B 63/00; E05B 63/0065; E05B 63/08; E05B 63/16; E05B 59/00; E05B 2001/0076

USPC ..... 292/2, 3, 32–34, 36, 37, 39, 40, 137, 292/163–165, 167, 169, 169.12, 169.22, 292/169.23, 172, 173, 138–140, 142, 143, 292/279; 70/106, 107, 110, 111, 129, 104, 70/124, 224, 141, 144, 145, 467–470, 472, 70/473, 474, 477, 481–483, DIG. 24

See application file for complete search history.

(56) References Cited

U.S. PATENT DOCUMENTS

| | | | | |
|---|---|---|---|---|
| 601,442 | A * | 3/1898 | Karsner | 70/154 |
| 1,576,007 | A * | 3/1926 | Springer | 70/107 |
| 5,265,920 | A * | 11/1993 | Kaup et al. | 292/40 |
| 5,495,731 | A * | 3/1996 | Riznik | 70/108 |
| 5,707,090 | A * | 1/1998 | Sedley | 292/172 |
| 6,266,981 | B1 * | 7/2001 | von Resch et al. | 70/107 |
| 6,324,876 | B1 * | 12/2001 | Prevot et al. | 70/107 |
| 6,993,946 | B1 * | 2/2006 | Shen | 70/472 |
| 7,878,034 | B2 * | 2/2011 | Alber | E05C 7/06 292/142 |
| 2006/0266088 | A1 * | 11/2006 | Lee et al. | 70/107 |

* cited by examiner

*Primary Examiner* — Alyson M Merlino
(74) *Attorney, Agent, or Firm* — IPLA P.A.; James E. Bame

(57) ABSTRACT

A mortise structure of a digital door lock is applicable to a left handed door and a right handed door. The mortise structure is an improved two-way releasable mortise structure which can unlock a latch bolt and a dead bolt by finally converting a rotary force of actuating means into a one-way rotary force even though the actuating means is rotated in an arbitrary direction.

7 Claims, 14 Drawing Sheets

TWO-WAY RELEASABLE MORTISE STRUCTURE

CROSS REFERENCES

Applicant claims foreign priority under Paris Convention to Korean Patent Application No. 10-2012-000041721, filed 20 Apr. 2012, with the Korean Intellectual Property Office, where the entire contents are incorporated herein by reference.

BACKGROUND OF THE INVENTION

1. Field of the Invention

The present invention relates to a two-way releasable mortise structure, and more particularly, to a two-way releasable mortise structure which can unlock a door lock even though actuation blocks for releasing a dead bolt and a latch bolt by receiving a rotary force by an indoor lever and an outdoor lever are rotated in an arbitrary direction.

2. Background of the Invention

A door lock is a device that is mounted on a door in order to lock and unlock the door according to whether a latch bolt and a dead bolt, which go in and out at the side of the door, are extended or retracted. The latch bolt is means for preventing an automatic opening of the door and is not locking means. Therefore, in order to solve the problem of the unsafe latch bolt, a mortise lock structure using the latch bolt and the dead bolt has been widely used.

A digital door lock can unlock the dead bolt by a driving force of a motor, and hence, such a digital door lock is very convenient because it can automatically move the dead bolt to a locked position through the driving force of the motor after the door is closed even though a user forgets door locking.

In the meantime, in the case that the user has to rapidly escape to the outside in emergency circumstances such as fires, because an action to unlock the dead bolt hinders the user from opening the door and escaping to the outside, a digital door lock with a panic structure that the latch bolt and the dead bolt are opened simultaneously just by manipulation of an indoor lever.

However, conventional digital door locks as well as Korean Utility Model Application No. 20-2011-6836 which is devised by the applicant of the present invention have an disadvantage in that an outdoor lever or an indoor lever must be changed in direction according to whether the door is a right handed door or a left handed door because the latch bolt and the dead bolt can be unlocked when actuating means for retracting the latch bolt and the dead bolt must be rotated in only one direction. Alternatively, push-and-pull open type door locks have an inconvenience in that rotary force converting means must be additionally mounted.

SUMMARY OF THE INVENTION

Accordingly, the present invention has been made to solve the above-mentioned problems occurring in the prior arts, and it is an object of the present invention to provide an improved two-way releasable mortise structure, which can unlock a latch bolt and a dead bolt by finally converting a rotary force of actuating means into an one-way rotary force even though the actuating means is rotated in an arbitrary direction.

To achieve the above objects, the present invention provides a two-way releasable mortise structure including: a latch bolt extended through a hole of a door frame to keep a closed state of a door; a latch actuation block rotatably actuated to tow the latch bolt so as to unlock the latch bolt; a latch actuation block operating part rotated by outdoor actuating means so as to rotate the latch actuation block; and a rotary force conversion member moving in interlock with the latch actuation block operating part and having an inclined plane in contact with the latch actuation block, wherein the latch actuation block operating part and the latch actuation block are independently rotated within a predetermined angle range, the latch actuation block operating part has a pressurizing portion and the latch actuation block has a pressure receiving portion which receives pressure by the pressurizing portion, so that the pressurizing portion pushes the pressure receiving portion and the latch actuation block operating part and the latch actuation block are integrally rotated in one direction when the latch actuation block operating part is rotated in one direction, and when the latch actuation block operating part is rotated in the opposite direction, the inclined plane pushes one side of the latch actuation block while the rotary force conversion member in interlock with the latch actuation block operating part moves, so as to rotate the latch actuation block in one direction.

In order to achieve the above object, the two-way releasable mortise structure further includes a latch link adapted to receive the rotary force from the latch actuation block to tow the latch bolt to one side.

Moreover, the latch actuation block is in a ring shape having a cut portion at one side and has end portions formed at both sides of the cut portion, and the pressure receiving portion of the latch actuation block is formed at one of the both end portions of the cut portion.

Furthermore, the latch actuation block operating part and the rotary force conversion member respectively have gear teeth which are in gear-engagement with each other.

Additionally, the latch actuation block has a latch retaining wing for towing the latch bolt and the inclined plane of the rotary force conversion member pushes the bottom of the latch retaining wing so as to rotate the latch actuation block.

In another aspect of the present invention, the present invention provides a two-way releasable mortise structure including: a dead bolt extended through a hole of a door frame to keep a closed state of a door; a simultaneously releasable actuation block rotatably actuated to tow the dead bolt so as to unlock the dead bolt; a simultaneously releasable actuation block operating part rotated by indoor actuating means so as to rotate the simultaneously releasable actuation block; and a rotary force conversion member moving in interlock with the simultaneously releasable actuation block operating part and having an inclined plane in contact with the simultaneously releasable actuation block, wherein the simultaneously releasable actuation block operating part and the simultaneously releasable actuation block are independently rotated within a predetermined angle range, the simultaneously releasable actuation block operating part has a pressurizing portion and the simultaneously releasable actuation block has a pressure receiving portion which receives pressure by the pressurizing portion, so that the pressurizing portion pushes the pressure receiving portion and the simultaneously releasable actuation block operating part and the simultaneously releasable actuation block are integrally rotated in one direction when the simultaneously releasable actuation block operating part is rotated in one direction, and when the simultaneously releasable actuation block operating part is rotated in the opposite direction, the inclined plane pushes one side of the simultaneously releasable actuation block while the rotary force conversion member in interlock with the simultaneously releasable actuation block operating part moves, so as to rotate the simultaneously releasable actuation block in one direction.

In order to achieve the above object, the simultaneously releasable actuation block tows the dead bolt by the dead bolt retaining wing for towing the dead bolt, and further has a latch bolt retaining wing for towing the latch bolt.

Moreover, the simultaneously releasable actuation block is in a ring shape having a cut portion at one side and has end portions formed at both sides of the cut portion, and the pressure receiving portion of the simultaneously releasable actuation block is formed at one of the both end portions of the cut portion.

Furthermore, the simultaneously releasable actuation block operating part and the rotary force conversion member respectively have gear teeth which are in gear-engagement with each other.

Additionally, the inclined plane of the rotary force conversion member pushes the bottom of the latch retaining wing of the simultaneously releasable actuation block so as to rotate the simultaneously releasable actuation block.

The two-way releasable mortise structure according to the present invention does not need additional devices for converting a direction of the rotary force because the rotary force is always output in only one direction by a rotary force conversion structure built in the mortise structure even though the indoor lever or the outdoor lever is rotated in any direction.

Therefore, the present invention is economical because the present invention can be applied to the push-and-pull type door locks regardless of right handed doors and left handed doors.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Reference will be now made in detail to the preferred embodiment of the present invention with reference to the attached drawings.

Figure 1:
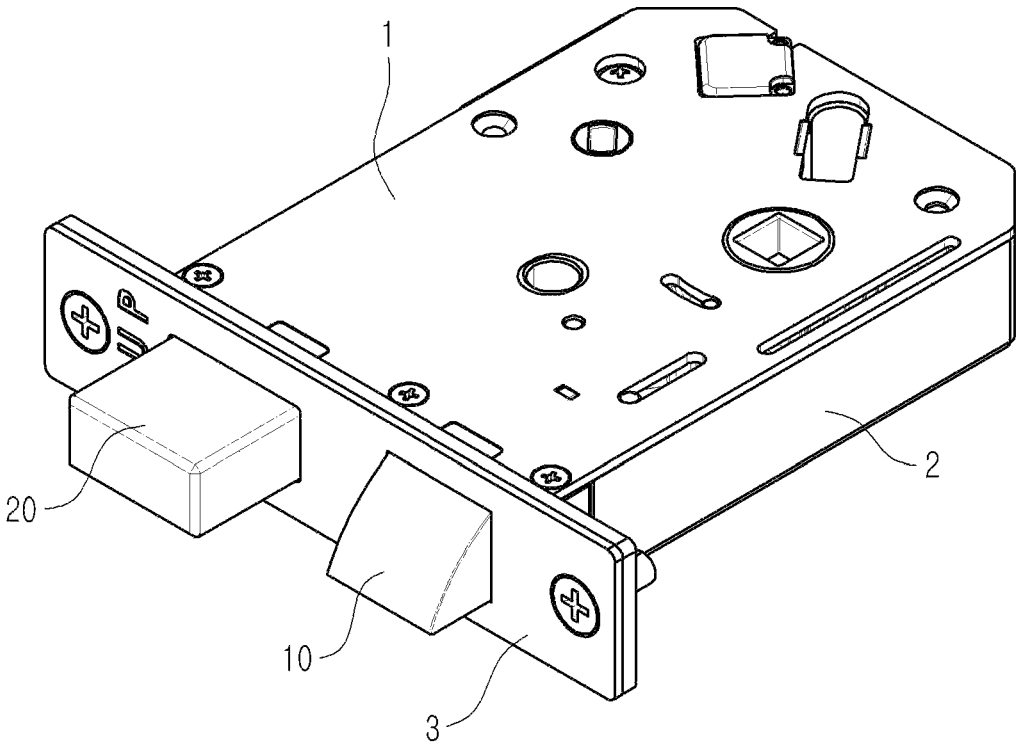
FIG. 1 is a perspective view showing an outward appearance of a two-way releasable mortise structure according to a preferred embodiment of the present invention.
Figure 2:
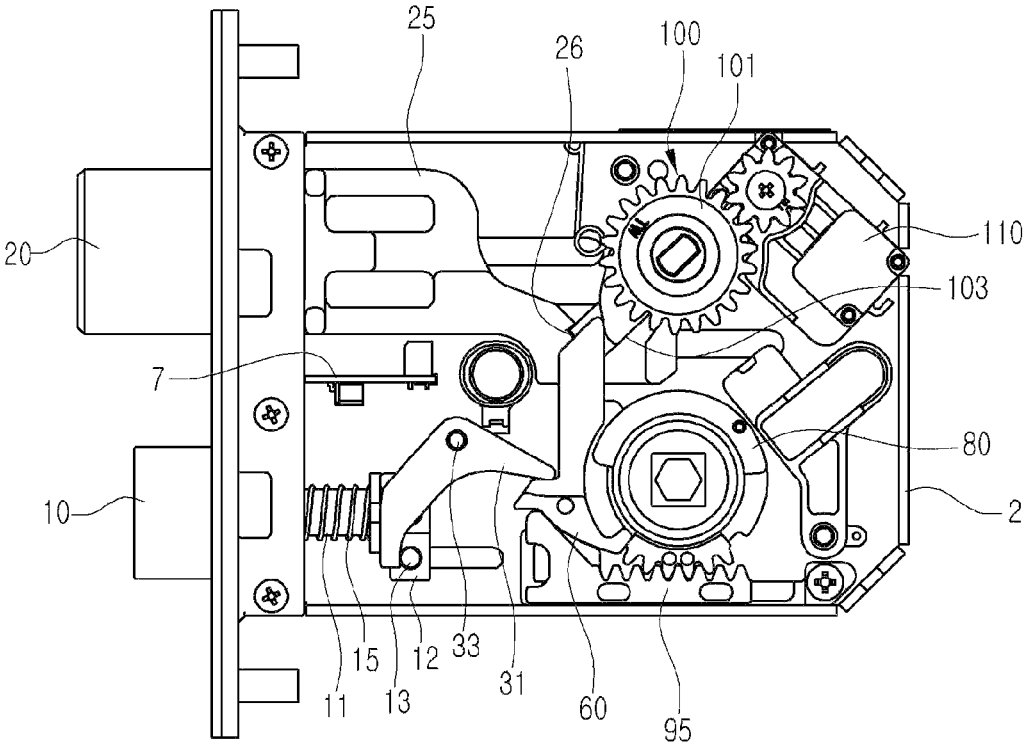
FIG. 2 is a plan view showing the inside structure of the two-way releasable mortise structure according to the preferred embodiment of the present invention.
Figure 3:
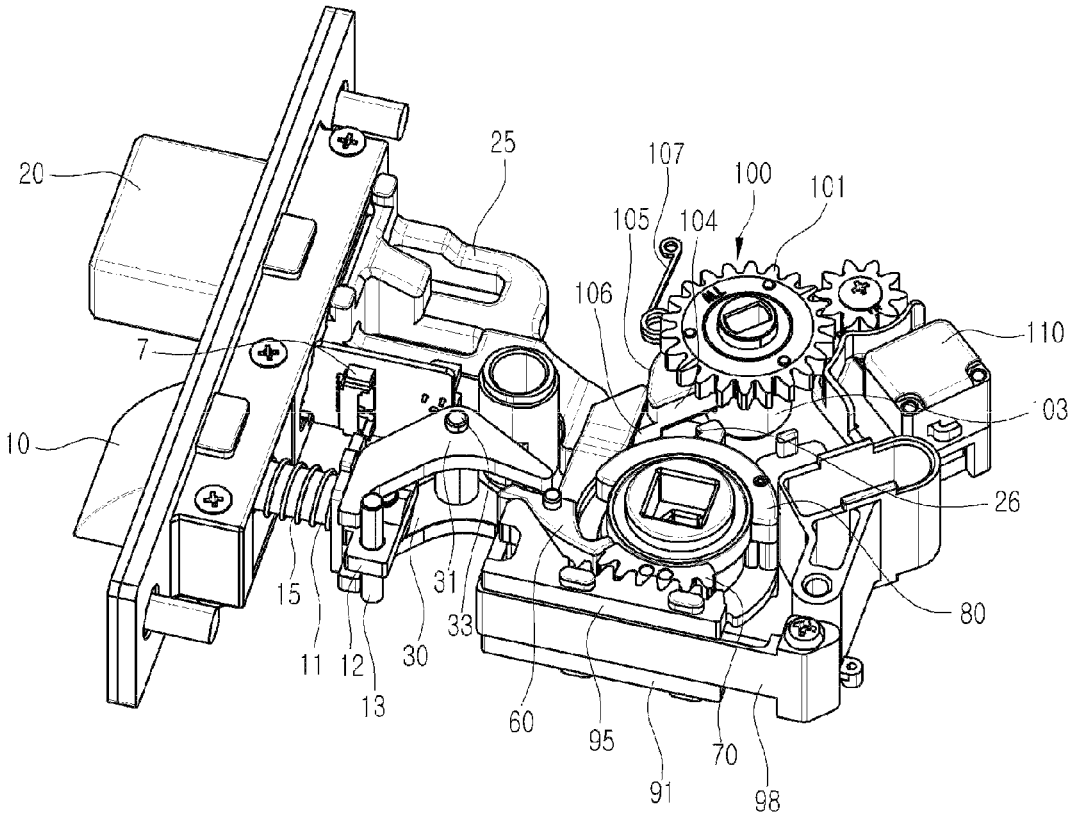
FIG. 3 is a perspective view showing the inside structure of the two-way releasable mortise structure from which an upper case and a lower case are removed.
Figure 4:
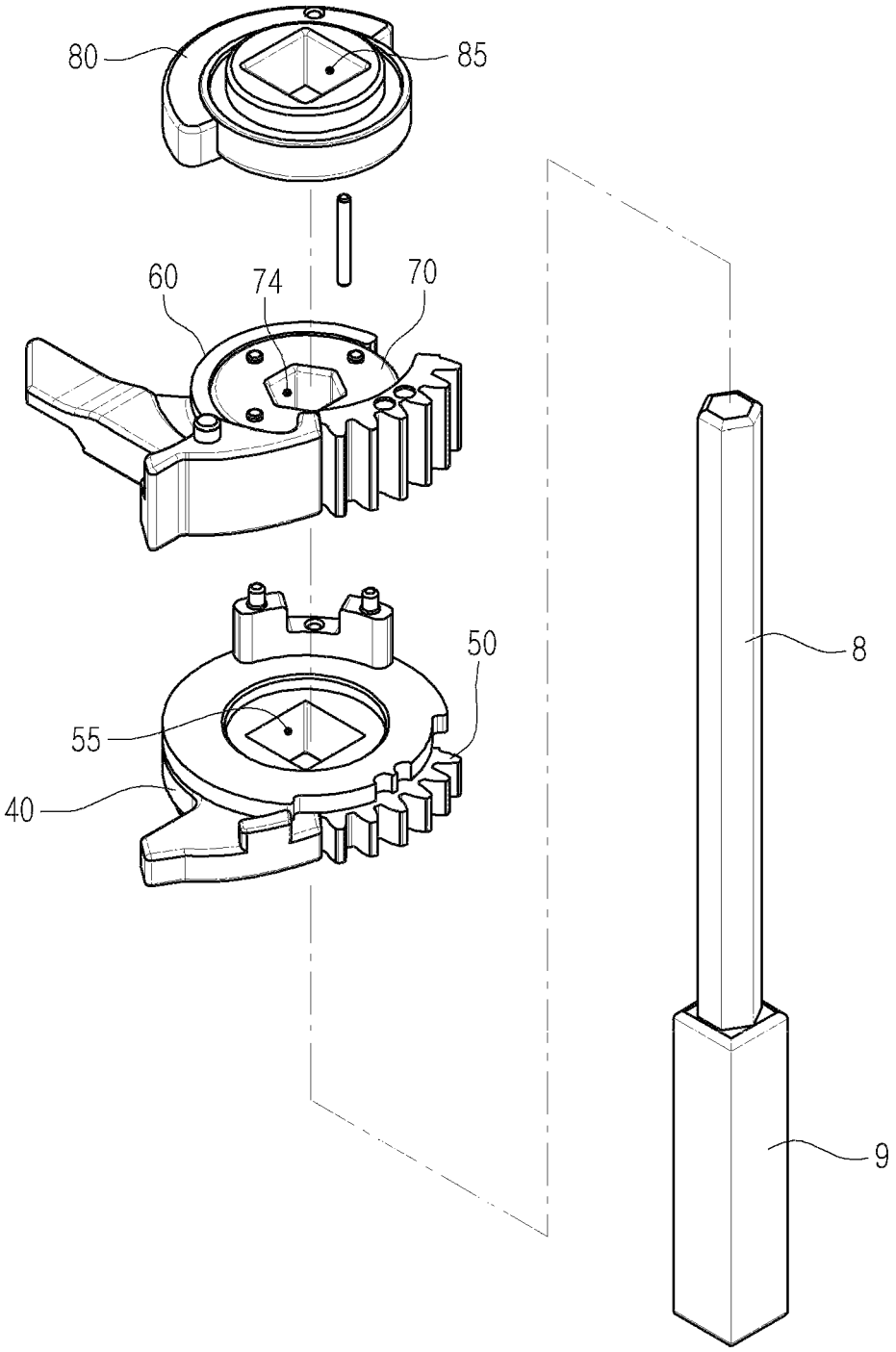
FIG. 4 is an exploded perspective view showing a latch actuation block, a simultaneously releasable actuation block, and their peripheral units of the two-way releasable mortise structure.
Figure 5:
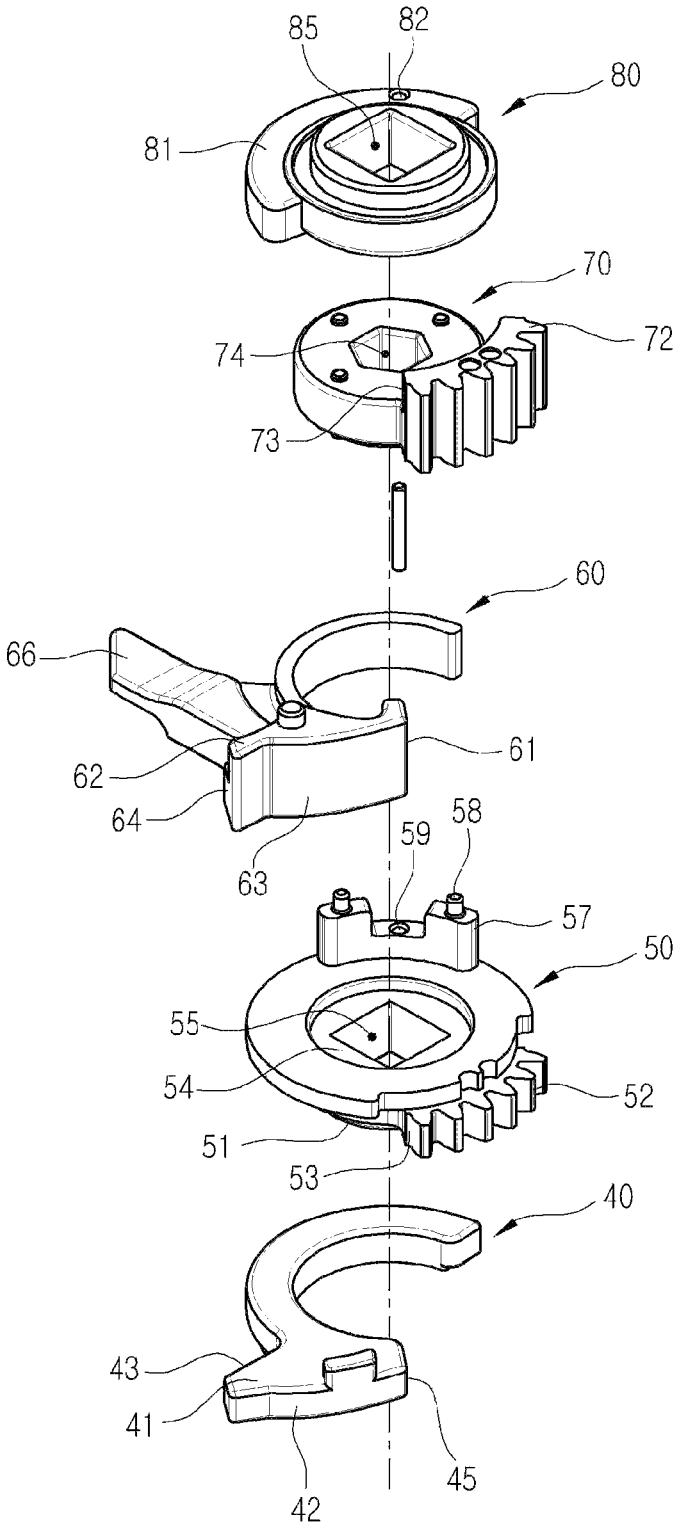
FIG. 5 is an exploded perspective view showing a latch actuation block, a simultaneously releasable actuation block, and peripheral units of the two-way releasable mortise structure.
Figure 6:
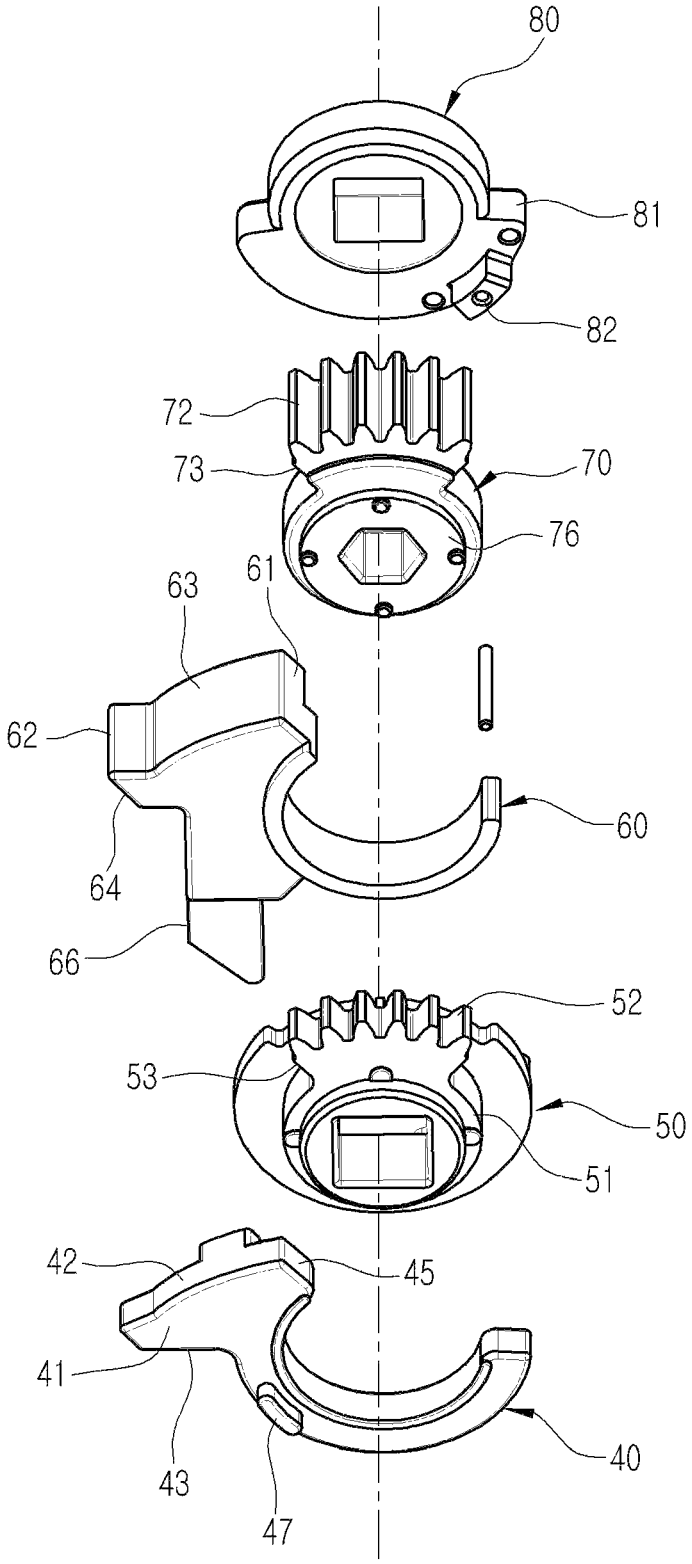
FIG. 6 is an exploded perspective view of the latch actuation block, the simultaneously releasable actuation block and the peripheral units viewed from the opposite direction of FIG. 5.
Figure 7:
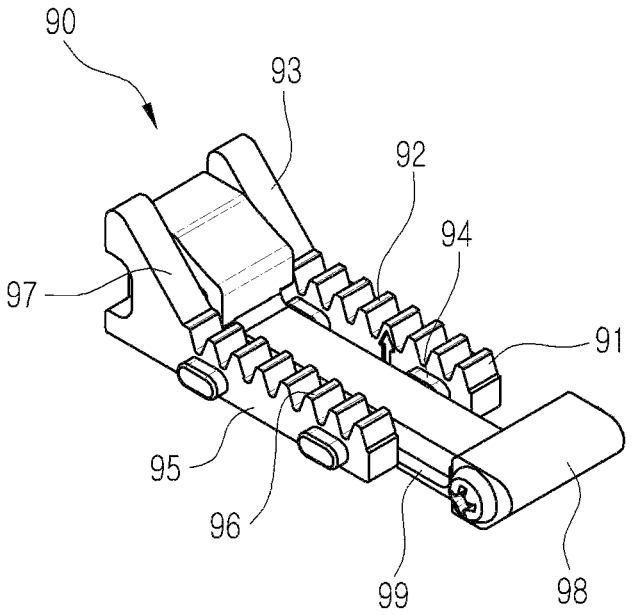
FIG. 7 is a perspective view of a rotary force converting member of the two-way releasable mortise structure.
Figure 8:
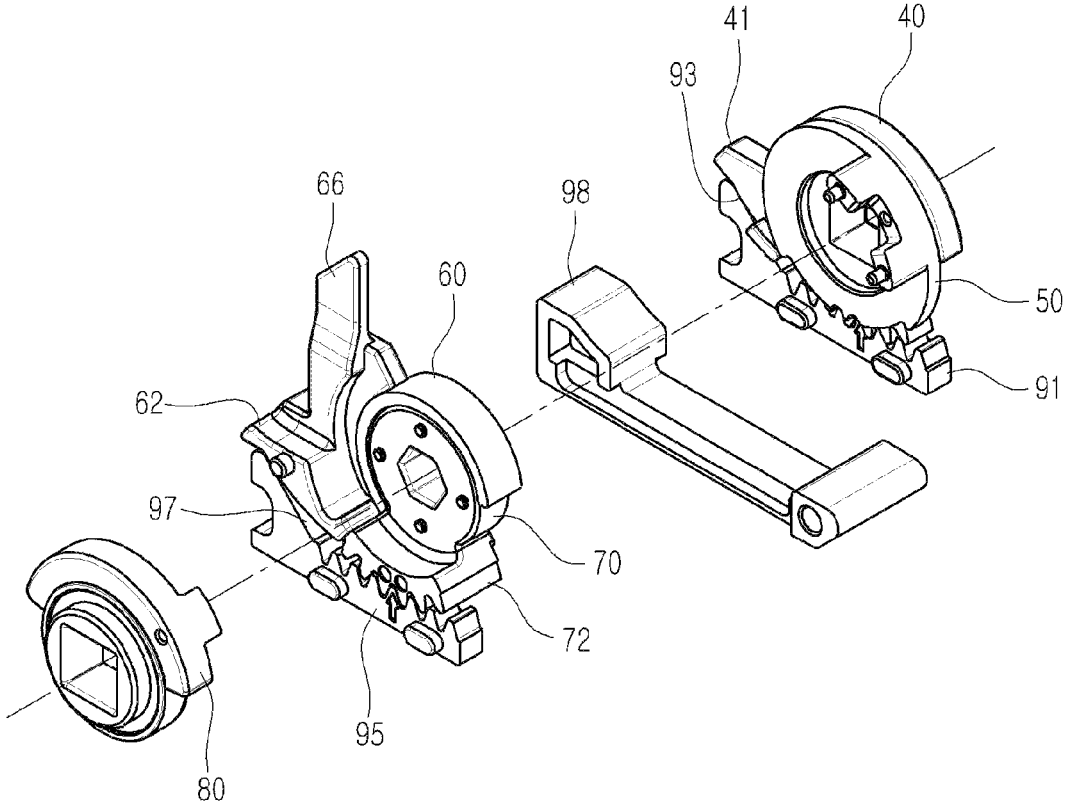
FIG. 8 is an exploded perspective view showing the rotary force converting member and its peripheral units of the two-way releasable mortise structure.

FIG. 1 is a perspective view showing an outward appearance of a two-way releasable mortise structure according to a preferred embodiment of the present invention, FIG. 2 is a plan view showing the inside structure of the two-way releasable mortise structure according to the preferred embodiment of the present invention, FIG. 3 is a perspective view showing the inside structure of the two-way releasable mortise structure from which an upper case and a lower case are removed, FIG. 4 is an exploded perspective view showing a latch actuation block, a simultaneously releasable actuation block, and their peripheral units of the two-way releasable mortise structure, FIG. 5 is an exploded perspective view showing a latch actuation block, a simultaneously releasable actuation block, and peripheral units of the two-way releasable mortise structure, FIG. 6 is an exploded perspective view of the latch actuation block, the simultaneously releasable actuation block and the peripheral units viewed from the opposite direction of FIG. 5, FIG. 7 is a perspective view of a rotary force converting member of the two-way releasable mortise structure, and FIG. 8 is an exploded perspective view showing the rotary force converting member and its peripheral units of the two-way releasable mortise structure.

As shown in FIGS. 1 to 3, the mortise structure according to the present invention includes an upper case 1 (of an indoor side), a lower case 2 (of an outdoor side), a body front 3, a latch bolt 10, a dead bolt 20, a first latch link 30, a second latch link 31, a latch actuation block 40, a simultaneously releasable actuation block 60, a power transmission part 100, and a gear box 110.

The upper case 1 and the lower case 2 protect the components of a digital door lock and are mounted on a door. Moreover, the lower case 2 (of the outdoor side) is provided with an outdoor lever (not shown in the drawings) mounted outside the lower case 2 for allowing a user to actuate the latch bolt 10 to open the door outdoors, and the upper case 1 (of the indoor side) is provided with an indoor lever (not shown in the drawings) mounted outside the upper case 1 for allowing the user to open the latch bolt 10 indoors.

The body front 3 is formed on the sides of the upper case 1 and the lower case, namely, on a groove of a door frame, and has holes where the latch bolt 10 and the dead bolt 20 can be extended and retracted.

The latch bolt 10 is provided to prevent the door from being opened by itself, namely to keep a closed state of the door, and has a tapered protrusion so that the latch bolt 10 is retracted in contact with the door frame when the door is closed.

Furthermore, the latch bolt 10 is transferred together with a latch shaft 11 joined to the latch bolt 10 and a latch plate 12 joined to the latch shaft 11. That is, the latch shaft 11 is inserted and joined to one side of the latch bolt 10, and the latch plate 12 having a plate post 13 which may be latched to a first latch link 30 or a second latch link 31 is joined to the other side of the latch shaft 11. Accordingly, when the latch actuation block 40 or the simultaneously releasable actuation block 60 is actuated by external force and the first latch link 30 or the second latch link 31 in interlock with the latch actuation block 40 or the simultaneously releasable actuation block 60 is rotated so as to pull the plate post 13, the latch bolt 10 is retracted into the door lock, and when the external force is removed, the latch bolt 10 is extended to the outside from the door lock by elasticity of a latch spring 15 supported on a latch bolt guide.

The dead bolt 20 is extended into the hole of the door frame to lock the door or is retracted from the hole of the door frame to unlock the door while moving forward or backward inside a space formed by the upper case 1 and the lower case 2. The dead bolt 20 is joined with a dead bolt slider 25 disposed at the rear of the dead bolt 20 and having a recess 26.

A closed-state sensor 7 is disposed between the latch bolt 10 and the dead bolt 20 for automatically getting the dead bolt 20 forward after checking a closed state of the door.

The first latch link 30 and the second latch link 31 are adapted to unlock the door by pulling the latch bolt, are formed in a boomerang shape, and are rotatably mounted on the lower case and rotated on a latch link shaft 33 as the axis of rotation. The first latch link 30 and the second latch link 31 respectively tow the lower end and the upper end of the plate post 13 disposed on the latch plate 12 so as to unlock the latch bolt 10.

As shown in FIGS. 4 to 6, the latch actuation block 40, a latch actuation block operating part 50, the simultaneously releasable actuation block 60, a simultaneously releasable actuation block operating part 70, and a latch actuation block interlocking part 80 are rotated by an actuation of the indoor lever or the outdoor lever, and are joined on the same rotary shaft.

The latch actuation block operating part 50, the simultaneously releasable actuation block operating part 70, and the latch actuation block interlocking part 80 respectively have joining holes 55, 74 and 85 to which an outdoor lever shaft 9 or an indoor lever shaft 8 is joined. In other words, the latch actuation block operating part 50 and the latch actuation block interlocking part 80 respectively have the polygonal outdoor lever joining holes 55 and 85 to which the outdoor lever shaft 9, which is a rotary shaft of the outdoor lever, is joined, and the simultaneously releasable actuation block operating part 70 has the polygonal indoor lever joining hole 74 to which the indoor lever shaft 8, which is a rotary shaft of the indoor lever, is joined. Cross sectional shapes of the outdoor lever shaft 9 and the indoor lever shaft 8 are respectively a square and a hexagon, and the joining holes 55, 74 and 85 of the latch actuation block operating part 50, the simultaneously releasable actuation block operating part 70, and the latch actuation block interlocking part 80 respectively have shapes corresponding to the shapes of the outdoor lever shaft 9 and the indoor lever shaft 8. Therefore, when the indoor lever shaft 8 is first inserted into the lower end of the latch actuation block operating part 50, the indoor lever shaft 8 penetrates through the outdoor lever joining hole 55, the indoor lever joining hole 74 and the outdoor lever joining hole 85, and the outdoor lever shaft 9 is inserted just into the outdoor lever joining hole 55. In other words, the indoor lever joining hole 74 is smaller than the outdoor lever joining holes 55 and 85 and the indoor lever shaft 8 is also smaller than the outdoor lever shaft 9, such that the indoor lever shaft 8 is closely seated into the indoor lever joining hole 74 after penetrating through the outdoor lever joining hole 55, but the outdoor lever shaft 9 does not penetrate through the indoor lever joining hole 74 and the upper end of the outdoor lever shaft 9 is closely seated into the outdoor lever joining hole 55.

The outdoor lever shaft 9 and the indoor lever shaft 8 are independently rotatably joined to each other through a ball joint (not shown in the drawings).

The latch actuation block 40 which tows the first latch link 30 in order to unlock the latch bolt 10 has a circular inner space, is in a ring shape having a cut portion at one side, and includes: a first latched wing 41 formed at one side thereof; a first pressure receiving portion 45 formed at an end portion of the cut portion; and a guide protrusion 47 formed at one side and forcedly fit into an arc-shaped through hole formed in the outer case 2. The latch actuation block 40 further includes a second pressure receiving portion 42 curvedly formed at a lower portion of the first latch retaining wing 41 and a first latch pressurizing portion 43 formed at an upper portion of the first latch retaining wing 41 to tow the first latch link 30.

The latch actuation block operating part 50 which is adapted to rotate the latch actuation block 40 includes: a round protrusion 51 inserted into the circular inner space of the latch actuation block 40; and gear teeth 52 formed on one side of the rim of the protrusion 51 within a predetermined angle range. The side of the gear tooth located at the outermost position of the gear teeth is a first interlock pressure portion 53. The latch actuation block operating part 50 further includes: a seating recess 54 formed at the center of the opposite side for seating the simultaneously releasable actuation block 60 thereon; a protruding guide 57 formed at the outer edge; and a joining protrusion 58 and a joining hole 59 formed at the top of the protruding guide 57. The latch actuation block operating part 50 has the square outdoor lever joining hole 55 formed at the center thereof.

The simultaneously releasable actuation block 60 which tows the second latch link and rotates the dead bolt operating lever 103 has a circular inner space, is in a ring shape having a cut portion at one side, and includes: a second latch retaining wing 62 and a dead bolt retaining wing 66 formed at one side thereof; a third pressure receiving portion 61 formed at an end portion of the cut portion. The simultaneously releasable actuation block 60 further includes a fourth pressure receiving portion 63 curvedly formed at a lower portion of the second latch retaining wing 62 and a second latch pressurizing portion 64 formed at an upper portion of the second latch retaining wing 62 to tow the second latch link 31.

The simultaneously releasable actuation block operating part 70 which is adapted to rotate the simultaneously releasable actuation block 60 is formed in a cylindrical shape, is inserted into the circular inner space of the simultaneously releasable actuation block 60, and has gear teeth 72 formed at one side of the rim thereof within a predetermined angle range. The side of the gear tooth located at the outermost position of the gear teeth 72 is a second interlock pressure portion 73. The simultaneously releasable actuation block operating part 70 further includes: the indoor lever joining hole 74 formed at the center thereof in a hexagonal shape; and a protrusion 76 formed at one side thereof and inserted into the seating recess 54 of the latch actuation block operating part 50.

The latch actuation block interlocking part 80 is located on the opposite side of the latch actuation block 40 in a state where the simultaneously releasable actuation block operating part 70 is interposed between latch actuation block interlocking part 80 and the latch actuation block 40 and is joined to the latch actuation block operating part 50. The latch actuation block interlocking part 80 which transfers a rotary force received from the outdoor lever to the latch actuation block operating part 50 so as to rotate the latch actuation block 40 includes the outdoor lever joining hole 85 formed at the center thereof; and an outer protrusion 81 formed at one side thereof within a predetermined angle section. The latch actuation block interlocking part 80 forms a space at the circumferential portion thereof excepting the outer protrusion 81 so that the gear teeth of the simultaneously releasable actuation block operating part 70 can be rotated in the space.

The outer protrusion 81 has a joining hole 82 to which a fixing piece is joined so as to be joined with the protrusion guide 57 of the latch actuation block operating part 50. The latch actuation block interlocking part 80 can transfer the rotary force of the outdoor lever to the latch actuation block operating part 50 regardless of whether the outdoor lever is joined to the front face or the rear face of the door lock, thereby realizing a door lock applicable not only to a right handed door but also to a left handed door.

Operational relationship among the latch actuation block 40, the latch actuation block operating part 50, the simultaneously releasable actuation block 60, the simultaneously releasable actuation block operating part 70, and the latch actuation block interlocking part 80 will be described as follows.

When the latch actuation block operating part 50 is rotated, the latch actuation block interlocking part 80 joined integrally with the latch actuation block operating part 50 is rotated, and the latch actuation block 40 pressurized by the latch actuation block operating part 50 is also rotated. In this instance, the simultaneously releasable actuation block 60 and the simultaneously releasable actuation block operating part 70 are not rotated. The reason is that the simultaneously releasable actuation block 60 and the simultaneously releasable actuation block operating part 70 are independently operated without any interlocking structure with the latch actuation block 40, the latch actuation block operating part 50, and the latch actuation block interlocking part 80.

In the meantime, when the simultaneously releasable actuation block operating part 70 is rotated, the simultaneously releasable actuation block 60 pressurized by the simultaneously releasable actuation block operating part 70 is also rotated, and in this instance, the latch actuation block 40, the latch actuation block operating part 50, and the latch actuation block interlocking part 80 are not rotated. The reason is that the latch actuation block 40, the latch actuation block operating part 50, and the latch actuation block interlocking part 80 are independently operated without any interlocking structure with the simultaneously releasable actuation block 60 and the simultaneously releasable actuation block operating part 70.

As shown in FIGS. 7 and 8, a rotary force converting member 90 serves to change a direction of the rotary force of the indoor lever or the outdoor lever and transfer the rotary force to the latch actuation block 40 or the simultaneously releasable actuation block 60, and includes: a latch operation side rack gear 91 which is geared with the latch actuation block operating part 50; a simultaneous operation side rack gear 95 geared with the simultaneously releasable actuation block operating part 70; and a slide guiding portion 98.

The latch operation side rack gear 91 is located beneath the latch actuation block operating part 50 and includes: a first rack gear 92 formed on an upper portion thereof and geared with the gear teeth of the latch actuation block operating part 50; a first inclined pressurizing portion 93 formed at one end and having an inclined plane; and a first guide protrusion 94 formed on the side of the latch operation side rack gear 91 and seated on a side upper portion 99 of the slide guiding portion 98. The latch operation side rack gear 91 is arranged in such a manner that the first inclined pressurizing portion 93 abuts on the second pressure receiving portion 42 of the latch actuation block 40.

The simultaneous operation side rack gear 95 is located beneath the simultaneously releasable actuation block operating part 70 and includes: a second rack gear 96 formed on an upper portion thereof and geared with the gear teeth of the simultaneously releasable actuation block operating part 70; a second inclined pressurizing portion 97 formed at one end and having an inclined plane; and a second guide protrusion (not shown in the drawings) formed on the side of the simultaneous operation side rack gear 95 and serving the same role as the first guide protrusion 94 which is seated on the side upper portion 99 of the slide guiding portion 98. The simultaneous operation side rack gear 95 is arranged in such a manner that the second inclined pressurizing portion 97 abuts on the fourth pressure receiving portion 63 of the simultaneously releasable actuation block 60.

The slide guiding portion 98 has the tiered side upper portions 99 respectively formed at both sides thereof so as to guide the guide protrusions of the simultaneous operation side rack gear 95 and the latch operation side rack gear 91 to slidably move on the tiered side upper portions 99.

The gear box 110 includes a motor (not shown in the drawings) and reduction gears (not shown in the drawings) connected with the motor, and serves to transfer a rotary force of the motor to the power transmission part which will be described later. A detailed description of the gear box 110 will be omitted because the gear box has been widely used.

The power transmission part 100 transfers the external force or the driving force of the motor to the dead bolt 20 to thereby transfer the dead bolt 20. The power transmission part 100 is rotated by the driving force of the gear box 110 including the motor, rotated by receiving a rotary force through a knob, or rotated by the rotary force transferred from the indoor lever to thereby transfer the dead bolt 20.

The power transmission part 100 includes a gear lever 101, a dead bolt operation lever 103 having the same rotary shaft as the gear lever 101, and an O-ring (not shown in the drawings).

The gear lever 101 has gear teeth formed on the circumferential surface thereof, and can rotate by receiving the rotary force from the gear box 110 through a gear engagement. The gear lever 101 is joined with the dead bolt operation lever 103 in a state where a rotational fragment (not shown) and the O-ring (not shown) are interposed therebetween. In other words, the gear lever 101 has the rotational fragment joined to the inside of the gear lever 101 through the O-ring, and the rotary force is transferred when the rotational fragment is caught to the dead bolt operation lever 103. The rotational fragment has an arc-shaped elongated hole of a predetermined length and the dead bolt operation lever 103 has a protrusion caught to the elongated hole, so that rotation of the rotational fragment is transferred to the dead bolt operation lever 103 just when the protrusion of the dead bolt operation lever 103 is caught to the end of the elongated hole of the rotational fragment when the gear lever 101 is rotated. The reason is to prevent the rotary force from being transferred to the gear box when the dead bolt operation lever 103 is rotated by the indoor lever by means of an idle space between the elongated hole of the rotational fragment and the protrusion of the dead bolt operation lever 103.

The dead bolt operation lever 103 which serves to transfer the dead bolt 20 includes: a manipulation arm 104 extended in one direction; an arc-shaped fifth pressure receiving portion 105 protrudingly formed on an upper portion of the manipulation arm 104 and pressurized by the dead bolt retaining wing 66 of the simultaneously releasable actuation block 60; and a dead bolt pressurizing portion 106 formed beneath the fifth pressure receiving portion 105 for selectively pressurizing one of both sides of the recess 26 of the dead bolt slider 25 connected to the dead bolt 20 to thereby transfer the dead bolt 20. Therefore, when the gear lever 101 is rotated by receiving the driving force from the gear box 110, the dead bolt operation lever 103 is rotated to transfer the dead bolt 20. Alternatively, when the indoor lever is rotated, the dead bolt retaining wing 66 of the simultaneously releasable actuation block 60 pushes the fifth pressure receiving portion 105 of the dead bolt operation lever 103, so that the dead bolt operation lever 103 transfers the dead bolt 20 while rotating. In this instance, a dead bolt spring 107 is joined between the dead bolt operation lever 103 and the lower case 2. Accordingly, when the manipulation arm 104 of the dead bolt operation lever 103 is rotated to a predetermined angle, the dead bolt spring 107 gives a rotary force to the dead bolt operation lever 103, and hence the manipulation arm 104 of the dead bolt operation lever 103 strongly pushes the dead bolt 20, so that the dead bolt 20 is retracted.

Hereinafter, the operation of the two-way releasable mortise structure according to the present invention will be described.

Figure 9:
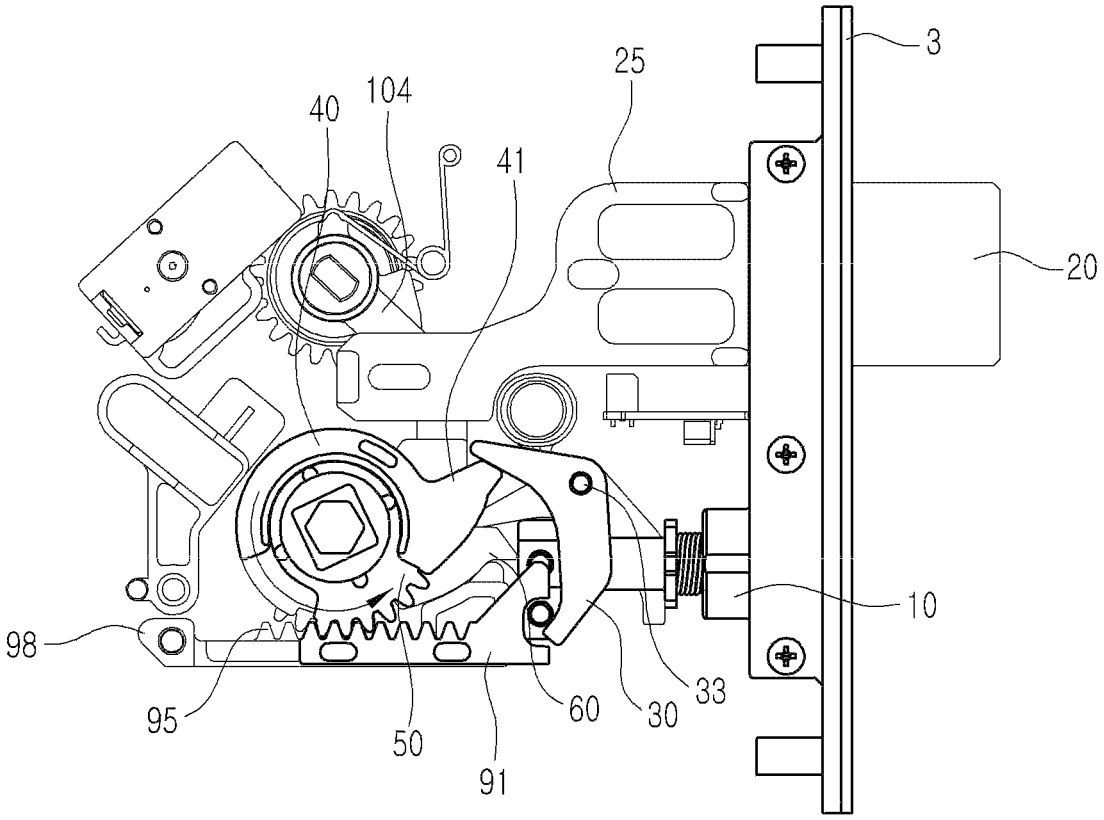
FIG. 9 is a view showing an operational state by an one-way rotation of the latch actuation block of the two-way releasable mortise structure.
Figure 10:
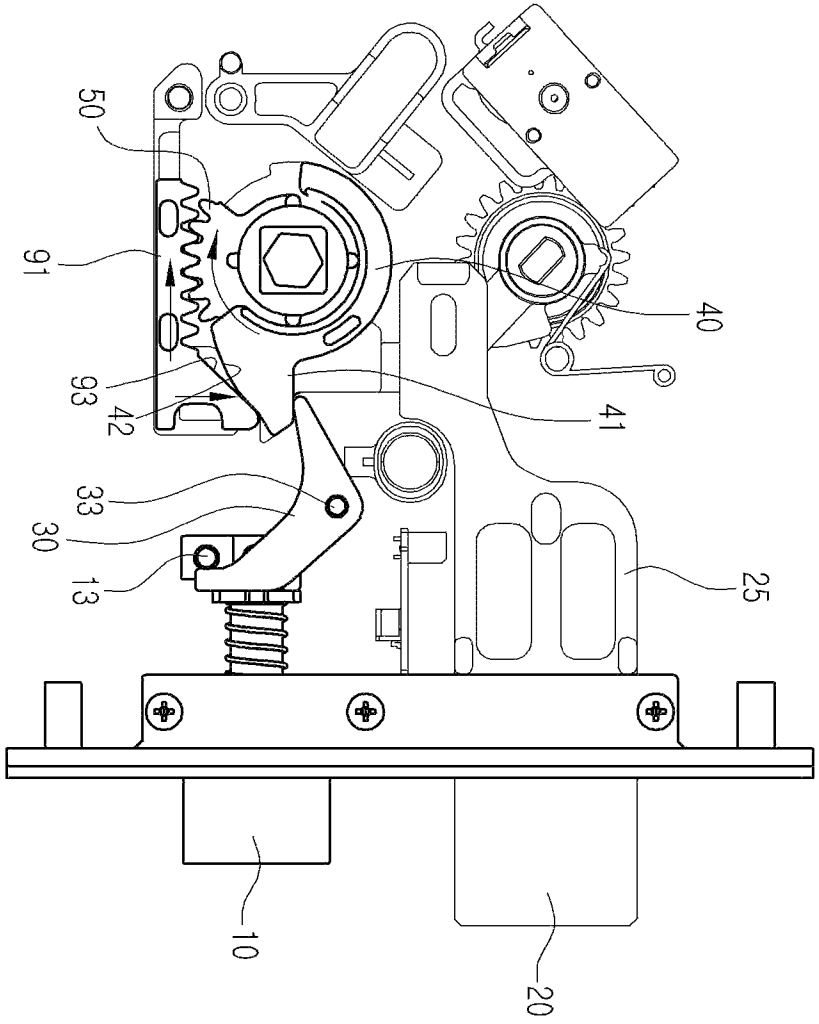
FIG. 10 is a view showing an operational state by a rotation of the latch actuation block in the opposite direction.
Figure 11:
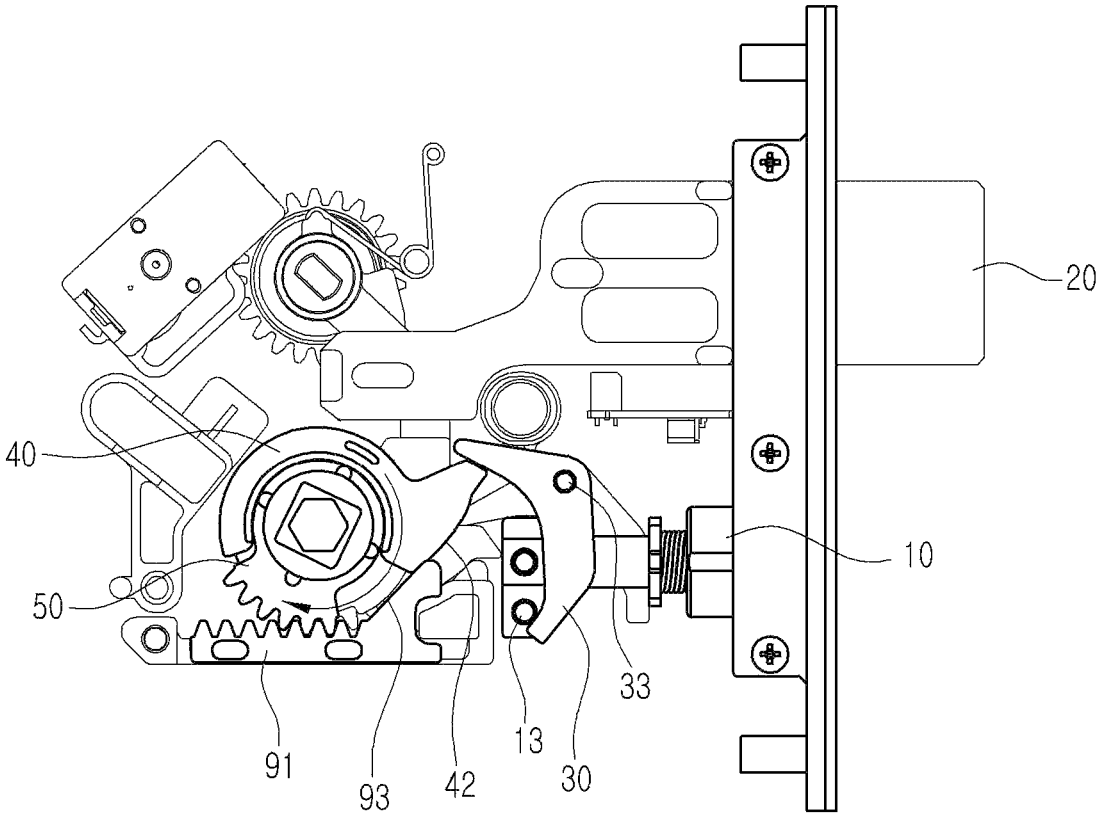
FIG. 11 is a view showing the final operational state of by the rotation of the latch actuation block in the opposite direction.

FIG. 9 is a view showing an operational state by an one-way rotation of the latch actuation block of the two-way releasable mortise structure, FIG. 10 is a view showing an operational state by a rotation of the latch actuation block in the opposite direction, and FIG. 11 is a view showing the final operational state of by the rotation of the latch actuation block in the opposite direction.

First, the operation of the two-way releasable mortise structure when the outdoor lever is rotated in the counter clockwise direction will be described.

As shown in FIG. 9, when the outdoor lever is rotated in the counter clockwise direction, the latch actuation block operating part 50 joined to the outdoor lever is rotated in the counter clockwise direction and the first interlock pressure portion 53 of the latch actuation block operating part 50 pushes the first pressure receiving portion 45 of the latch actuation block 40, so that the latch actuation block 40 is rotated in the counter clockwise direction. In this instance, the latch operation side rack gear 91 which is geared with the latch actuation block operating part 50 is moved to the right. When the latch actuation block 40 rotates in the counter clockwise direction, the first latch retaining wing 41 tows and rotates the first latch link 30, and the first latch link 30 pulls the plate post 13 so as to retract the latch bolt 10 into the door lock.

Next, the operation of the two-way releasable mortise structure when the outdoor lever is rotated in the clockwise direction will be described.

As shown in FIGS. 10 and 11, when the outdoor lever is rotated in the clockwise direction, the latch actuation block operating part 50 is rotated in the clockwise direction and the latch operation side rack gear 91 which is geared with the latch actuation block operating part 50 is moved to the left. When the latch operation side rack gear 91 is moved to the left, the first inclined pressurizing portion 93 of the latch operation side rack gear 91 pushes up the second pressure receiving portion 42 of the latch actuation block 40, and when the second pressure receiving portion 42 of the latch actuation block 40 is pushed up, the latch actuation block 40 is rotated in the counter clockwise direction. When the latch actuation block 40 is rotated in the counter clockwise direction, the first latch retaining wing 41 tows and rotates the first latch link 30, and the first latch link 30 pulls the plate post 13 so as to retract the latch bolt 10 into the door lock. The latch operation side rack gear 91 serves to change the direction of the rotary force of the outdoor lever and transfer the rotary force to the latch actuation block 40.

Now, the operation of the two-way releasable mortise structure when the indoor lever is rotated in the clockwise direction will be described.

Figure 12:
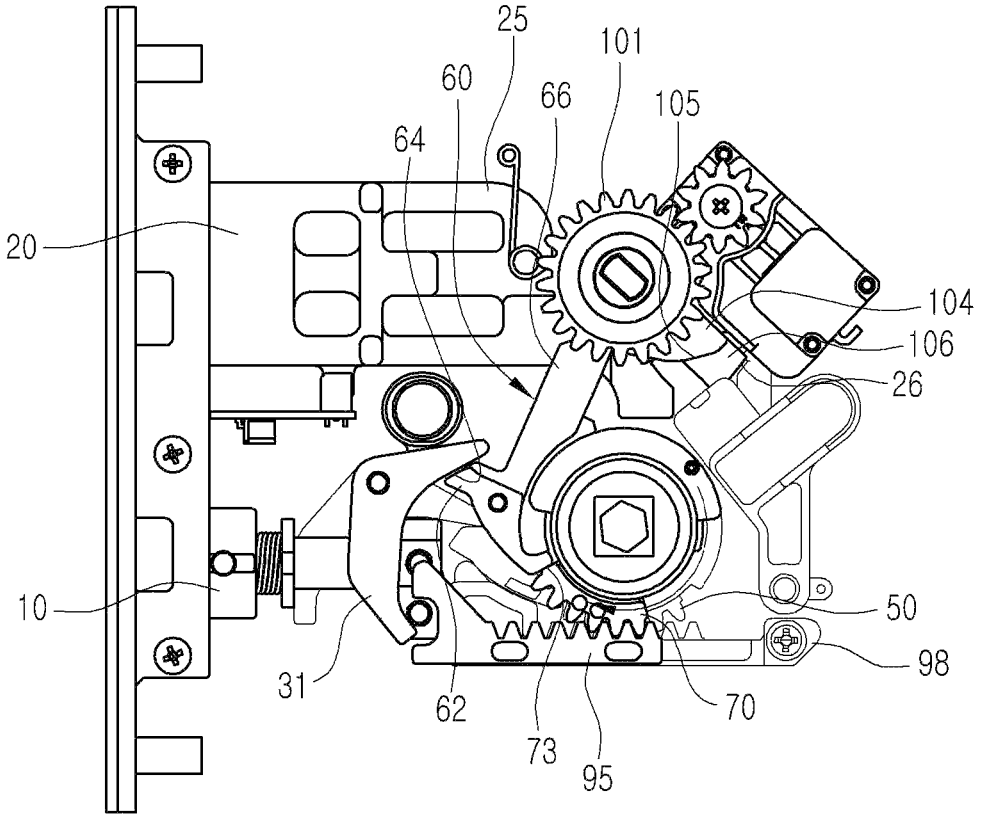
FIG. 12 is a view showing an operational state by an one-way rotation of the simultaneously releasable actuation block of the two-way releasable mortise structure.

As shown in FIG. 12, when the indoor lever is rotated in the clockwise direction, the simultaneously releasable actuation block operating part 70 is rotated in the clockwise direction and the second interlock pressure portion 73 of the simultaneously releasable actuation block operating part 70 pushes the fourth pressure receiving portion 63 of the simultaneously releasable actuation block 60, so that the simultaneously releasable actuation block 60 is rotated in the clockwise direction. In this instance, the simultaneous operation side rack gear 95 which is geared with the simultaneously releasable actuation block operating part 70 is moved to the left. When the simultaneously releasable actuation block 60 rotates in the clockwise direction, the second latch retaining wing 62 tows and rotates the second latch link 31, and the second latch link 31 pulls the plate post 13 so as to retract the latch bolt 10 into the door lock and the dead bolt retaining wing 66 rotates the dead bolt operation lever 103 so as to retract the dead bolt 20 into the door lock.

Next, the operation of the two-way releasable mortise structure when the indoor lever is rotated in the counter clockwise direction will be described.

Figure 13:
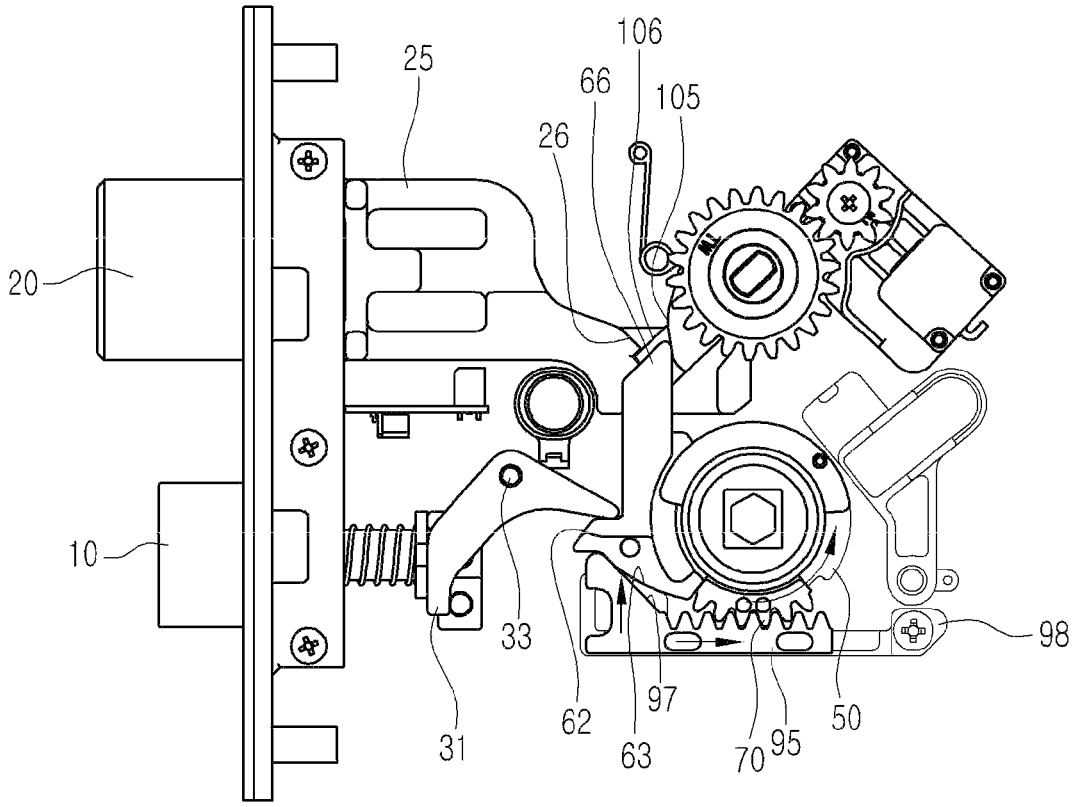
FIG. 13 is a view showing an operational state by a rotation of the simultaneously releasable actuation block in the opposite direction.
Figure 14:
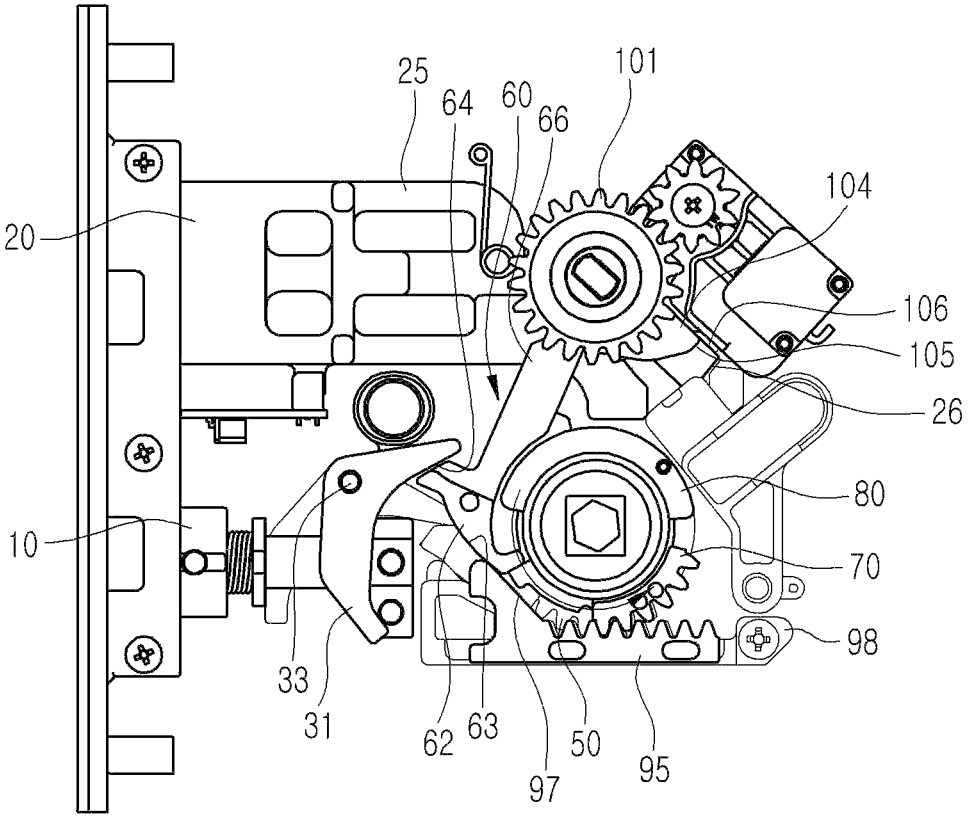
FIG. 14 is a view showing the final operational state of by the rotation of the simultaneously releasable actuation block in the opposite direction

As shown in FIGS. 13 and 14, when the indoor lever is rotated in the counter clockwise direction, the simultaneously releasable actuation block operating part 70 is rotated in the counter clockwise direction and the simultaneous operation side rack gear 95 which is geared with the gear teeth 72 of the simultaneously releasable actuation block operating part 70 is moved to the right. When the simultaneous operation side rack gear 95 is moved to the right, the second inclined pressurizing portion 97 of the simultaneous operation side rack gear 95 pushes up the fourth pressure receiving portion 63 of the simultaneously releasable actuation block 60, and when the fourth pressure receiving portion 63 of the simultaneously releasable actuation block 60 is pushed up, the simultaneously releasable actuation block 60 is rotated in the clockwise direction. When the simultaneously releasable actuation block 60 is rotated in the clockwise direction, the second latch retaining wing 62 tows and rotates the first latch link 30, and the first latch link 30 pulls the plate post 13 so as to retract the latch bolt 10 into the door lock, and the dead bolt retaining wing 66 rotates the dead bolt operation lever 103 so as to retract the dead bolt 20 into the door lock. That is, the simultaneous operation side rack gear 95 serves to rotate the simultaneously releasable actuation block 60 in the opposite direction to the direction of the rotary force of the indoor lever.

As described above, because the simultaneously releasable actuation block 60 is always rotated in the clockwise direction, namely, in the direction to unlock the latch bolt 10 and the dead bolt 20, regardless of whether the indoor lever is rotated in the clockwise direction or in the counter clockwise direction, the latch bolt 10 and the dead bolt 20 can be unlocked even though the indoor lever is rotated in any direction.

As described above, in the case that the mortise structure according to the present invention is mounted to the left handed door or the right handed door, the mortise structure can unlock the latch bolt or the dead bolt when the latch actuation block 40 or the simultaneously releasable actuation block 60 is rotated in the same rotational direction because the latch actuation block 40 or the simultaneously releasable actuation block 60 is rotated in the direction to unlock the latch bolt or the dead bolt even though the indoor lever or the outdoor lever is rotated in any direction of the clockwise direction and the counter clockwise direction. In the case of the door locks according to the prior arts, the rotational direction of the outside handle or the indoor lever must be changed according to the right handed door and the left handed door because the latch actuation block or the simultaneously releasable actuation block of the door lock must be changed in rotational direction according to the right handed door and the left handed door. Additionally, in the case of the push-and-pull open type door locks, because the user can take only an action to pull the knob outside the door and take only an action to push the knob inside the door, in order to change the rotational direction of the latch actuation block or the simultaneously releasable actuation block of the door lock, different power conversion modules for converting a rectilinear motion into a rotational motion must be mounted according to the right handed door and the left handed door. However, the mortise structure according to the present invention does not need such a component for changing the rotation direction of the knob according to the right handed door and the left handed door because the latch bolt 10 or dead bolt 20 of the door lock can be unlocked regardless of the rotational direction of the latch actuation block 40 or the simultaneously releasable actuation block 60 of the door lock. Particularly, in the case that the mortise structure of the present invention is applied to the push-and-pull open type door lock, there is no need to be provided with two types of power conversion modules.

Moreover, the mortise structure according to the present invention has a panic function that only the latch bolt 10 is unlocked when the outdoor lever is manipulated and the latch bolt 10 and the dead bolt 20 are simultaneously unlocked when the indoor lever is manipulated. However, when the outdoor lever and the indoor lever are manipulated, the latch bolt 10 is (or the latch bolt 10 and the dead bolt 20 are) unlocked by movements of the completely independent components. That is, because the manipulation of the indoor lever has absolutely no effect on the outdoor lever, there is no concern that the user located outdoors hurts his or her hand by an unintended movement of the outdoor lever.

Furthermore, in emergency circumstances such as fires, even though the outdoor lever is not rotatable due to breakdown or damage, because the latch actuation block 40 joined to the outdoor lever and the simultaneously releasable actuation block 60 joined to the indoor lever are rotated completely independently, the user can rotate the indoor lever in order to rapidly open the door and escape from the space.

The terms of the outdoor lever and the indoor lever used in the present invention comprehensively name components formed at the outdoor side and the indoor side for transferring the rotary force to the door lock so as to unlock the door lock, and it is interpretable that the outdoor lever and the indoor lever may be a rotatable knob, actuating means of the push-and-pull open type door lock, and other alternative actuating means.

In the present invention, the simultaneous operation side rack gear 95 and the latch operation side rack gear 91 are used as the rotary force conversion member 90 which transfers the rotary force to the latch actuation block 40 and the simultaneously releasable actuation block 60 by the rotation of the latch actuation block operating part 50 and the simultaneously releasable actuation block operating part 70, but it is just an example of the power transmission way of the latch actuation block operating part 50 and the simultaneously releasable actuation block operating part 70 and the rotary force conversion member 90, and in the present invention, the power transmission way of the latch actuation block operating part 50 and the simultaneously releasable actuation block operating part 70 and the rotary force conversion member 90 may be realized not by the gear engagement but by one of various well-known methods. For instance, the latch actuation block operating part 50 and the simultaneously releasable actuation block operating part 70 may respectively have retaining protrusions in place of the gear teeth and the rotary force conversion member 90 may be caught to the retaining protrusions to thereby take a rectilinear slide motion.

While the present invention has been particularly shown and described with reference to the example embodiment thereof, it will be understood by those of ordinary skill in the art that various changes, modifications and equivalents may be made therein without departing from the technical idea and scope of the present invention as defined by the following claims.

What is claimed is:

1. A two-way releasable mortise structure comprising:

a latch bolt extended through a hole of a door frame in a locked position to maintain a closed state of a door;

a latch actuation block rotatably actuated to tow the latch bolt to an unlocked position;

a latch actuation block operating part rotated by outdoor actuating means so as to rotate the latch actuation block to tow the latch bolt to the unlocked position;

a dead bolt extended through a hole of the door frame in a locked position to maintain the closed state of a door;

a simultaneously releasable actuation block rotatably actuated to tow the dead bolt to an unlocked position;

a simultaneously releasable actuation block operating part rotated by indoor actuating means so as to rotate the simultaneously releasable actuation block; and a rotary force conversion member moving in interlock with the latch actuation block operating part and having a first inclined plane in contact with the latch actuation block, and moving in interlock with the simultaneously releasable actuation block operating part and having a second inclined plane in contact with the simultaneously releasable actuation block to tow the dead bolt to the unlocked position, wherein the latch actuation block operating part has a pressurizing portion and the latch actuation block has a pressure receiving portion which receives pressure by the pressurizing portion, so that the pressurizing portion pushes the pressure receiving portion, causing the latch actuation block operating part and the latch actuation block to be integrally rotated in a first direction when the latch actuation block operating part is rotated in the first direction by the outdoor actuating means, and wherein when the latch actuation block operating part is rotated by the outdoor actuating means in in a second direction, opposite to the first direction, the first inclined plane of the rotary force conversion means pushes one side of the latch actuation block while the rotary force conversion member, in interlock with the latch actuation block operating part, moves so as to rotate the latch actuation block in the first direction to tow the latch bolt to the unlocked position, wherein the latch actuation block partially encloses the latch actuation block operating part, and the latch actuation block operating part is rotated in the second direction by the outdoor actuating means within a predetermined angle range before the latch actuation block is rotated in the first direction by the movement of the rotary force conversion member, and is rotated together with the latch actuation block in the first direction within another predetermined angle range by the outdoor actuating means, wherein the simultaneously releasable actuation block operating part has a pressurizing portion and the simultaneously releasable actuation block has a pressure receiving portion, which received pressure by the pressuring portion, so that the pressurizing portion pushes the pressure receiving portion, causing the simultaneously releasable actuation block operating part and the simultaneously releasable actuation block to be integrally rotated in a third direction when the simultaneously releasable actuation block operating part is rotated in the third direction by the indoor actuation means to tow the dead bolt to the unlocked position, wherein when the simultaneously releasable actuation block operating part is rotated by the indoor actuating means in a fourth direction, opposite to the third direction, the second inclined plane of the rotary force conversion member pushes one side of the simultaneously releasable actuation block while the rotary force conversion member, in interlock with the simultaneously releasable actuation block operating part, moves so as to rotate the simultaneously releasable actuation block in the third direction to tow the dead bolt to the unlocked position, wherein the simultaneously releasable actuation block partially encloses the simultaneously releasable actuation block, and the simultaneously releasable actuation block operating part is rotated in the fourth direction by the indoor actuating means within a predetermined angle range before the simultaneously releasable actuation block is rotated in the third direction by the movement of the rotary force conversion member, and is rotated together with the simultaneously releasable actuation block in the third direction within another predetermined angle range by the indoor actuating means.

2. The two-way releasable mortise structure according to claim 1, further comprising:

a latch link adapted to receive a rotary force from the latch actuation block to tow the latch bolt to the unlocked position.

3. The two-way releasable mortise structure according to claim 1, wherein the latch actuation block has a ring shape including a cut portion at one side and has end portions formed at either side of the cut portion, and the pressure receiving portion of the latch actuation block is formed at one of the end portions of the cut portion.

4. The two-way releasable mortise structure according to claim 1, wherein the latch actuation block has a latch retaining wing for towing the latch bolt to the unlocked position and the first inclined plane of the rotary force conversion member pushes a bottom of the latch retaining wing so as to rotate the latch actuation block to tow the latch bolt to the unlocked position.

5. The two-way releasable mortise structure according to claim 1, wherein the simultaneously releasable actuation block tows the dead bolt to the unlocked position by a dead bolt retaining wing for towing the dead bolt, and further has a latch bolt retaining wing for towing the latch bolt.

6. The two-way releasable mortise structure according to claim 1, wherein the simultaneously releasable actuation block has a ring shape including a cut portion at one side and has end portions formed at either side of the cut portion, and the pressure receiving portion of the simultaneously releasable actuation block is formed at one of the end portions of the cut portion.

7. The two-way releasable mortise structure according to claim 1, wherein the second inclined plane of the rotary force conversion member pushes a bottom of a latch retaining wing of the simultaneously releasable actuation block so as to rotate the simultaneously releasable actuation block to tow the dead bolt to the unlocked position.

* * * * *